US007095310B2

(12) United States Patent
Imai et al.

(10) Patent No.: US 7,095,310 B2
(45) Date of Patent: Aug. 22, 2006

(54) NONLINEAR RESISTOR AND METHOD OF MANUFACTURING THE SAME

(75) Inventors: Toshiya Imai, Kawasaki (JP); Hideyasu Ando, Tokyo (JP); Susumu Nishiwaki, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 11/114,012

(22) Filed: Apr. 26, 2005

(65) Prior Publication Data

US 2005/0195065 A1 Sep. 8, 2005

Related U.S. Application Data

(63) Continuation of application No. 09/677,886, filed on Oct. 3, 2000, now abandoned.

(30) Foreign Application Priority Data

Oct. 4, 1999 (JP) ..... 11-282871
Aug. 31, 2000 (JP) ..... 2000-262950

(51) Int. Cl.
*H01C 7/10* (2006.01)

(52) U.S. Cl. ..... 338/21; 338/224

(58) Field of Classification Search ..... 338/20, 338/21, 22 R, 22 SD, 223, 224, 313–314, 338/322

See application file for complete search history.

(56) References Cited

U.S. PATENT DOCUMENTS 2,253,360 A 8/1941 Berkey
2,253,376 A 8/1941 Johnson
2,328,644 A 9/1943 Happe
2,588,250 A 3/1952 Kopelman
3,138,686 A 6/1964 Mitoff et al.
3,813,296 A 5/1974 McStrack et al.
3,872,582 A 3/1975 Matsuoka et al.
3,959,543 A 5/1976 Ellis
4,272,411 A 6/1981 Sokoly et al.
4,317,101 A 2/1982 Ellis et al.
4,319,215 A 3/1982 Yamazaki et al.
4,420,737 A 12/1983 Miyoshi et al.
4,423,404 A 12/1983 Goedde et al.
4,450,426 A 5/1984 Miyoshi et al.
4,559,167 A 12/1985 Julke et al.

(Continued)

FOREIGN PATENT DOCUMENTS

DE 2 417 523 12/1974

(Continued)

OTHER PUBLICATIONS

JP50027986 (abstract) (Jul. 1978).

*Primary Examiner*—Tu Hoang
(74) *Attorney, Agent, or Firm*—Oblon, Spivak, McClelland, Maier & Neustadt, P.C.

(57) ABSTRACT

A non-linear resistor comprises a sintered body having zinc oxide as a main component, a side-surface high resistance layer arranged at a side-surface of the sintered body, and an electrode arranged at upper and lower surfaces of the sintered body. The side-surface high resistance layer is formed of a specifically selected material. The end-to-end distance between an end portion of the electrode and a nonlinear resistor end portion including the side-surface high resistance layer falls within a range of 0 mm to the thickness of the side-surface high resistance layer+0.01 mm.

9 Claims, 3 Drawing Sheets

U.S. PATENT DOCUMENTS

| | | | |
|---|---|---|---|
| 4,692,735 | A | 9/1987 | Shoji et al. |
| 4,719,064 | A | 1/1988 | Nakata et al. |
| 4,835,508 | A | 5/1989 | Seike et al. |
| 5,096,620 | A | 3/1992 | Ditz et al. |
| 5,264,819 | A | 11/1993 | Nied et al. |
| 5,294,908 | A | 3/1994 | Katsumata et al. |
| 5,307,046 | A | 4/1994 | Alim |
| 5,387,432 | A | 2/1995 | Alim et al. |
| 5,455,554 | A | 10/1995 | Sletson et al. |
| 5,610,570 | A | 3/1997 | Yamada et al. |
| 5,629,666 | A | 5/1997 | Imai et al. |
| 6,018,287 | A | 1/2000 | Katsumata et al. |
| 6,163,245 | A | 12/2000 | Andoh et al. |

FOREIGN PATENT DOCUMENTS

| | | |
|---|---|---|
| DE | 31 23 552 | 4/1982 |
| DE | 689 10 640 | 5/1990 |
| DE | 692 10 473 | 12/1992 |
| EP | 0 827 161 | 3/1998 |
| EP | 0 924 714 | 6/1999 |
| FR | 2 363 171 | 3/1978 |
| JP | 49-30896 | 3/1974 |
| JP | 50-27986 | 3/1975 |
| JP | 3-208304 | 9/1991 |
| JP | 04290204 | 10/1992 |
| JP | 7-263204 | 10/1995 |

NONLINEAR RESISTOR AND METHOD OF MANUFACTURING THE SAME

CROSS-REFERENCE TO RELATED APPLICATIONS

This application is a continuation of U.S. application Ser. No. 09/677,886 filed on Oct. 3, 2000 now abandoned, and in turn is based upon and claims the benefit of priority from the prior Japanese Patent Application No. 11-282871, filed Oct. 4, 1999; and No. 2000-262950, filed Aug. 31, 2000, the entire contents of each of which are hereby incorporated herein by reference.

BACKGROUND OF THE INVENTION

The present invention relates to a nonlinear resistor for use in an overvoltage protection device and a method of manufacturing the same. More specifically, the present invention relates to a nonlinear resistor having an electrode and a side-surface high resistance layer and the method of manufacturing the same.

Generally in an electric power system, an overvoltage protection device such as a lightning arrester or a surge absorber is used in order to protect the electric power system by removing overvoltage which is superposed on a normal voltage. In the overvoltage protection device, a nonlinear resistor is mainly used. The nonlinear resistor used herein is characterized in that it exhibits substantially insulating characteristics under a normal voltage and a relatively low resistance when an overvoltage is applied.

The nonlinear resistor of this type has a sintered body. The sintered body is formed of zinc oxide as a main component and at least one type of metal oxide as the additive. The additive is used in order to obtain the nonlinear resistor characteristics. The materials are mixed, granulated, molded, and sintered to form the sintered body. At the side surface of the sintered body, a side-surface high resistance layer is formed in order to prevent a flashover from the side surface when a surge is absorbed. Furthermore, an electrode is formed on each of upper and lower surfaces of the sintered body such that a current flows uniformly through the sintered body.

In the electrode of the nonlinear resistor mentioned above, a ring-form electrode nonformation portion is provided, in most cases, in a circumference portion of the nonlinear resistor in such a manner that an electrode end portion does not overlap with the sintered-body end portion in order to avoid a flashover as much as possible when a large current is supplied.

Methods for forming the electrode nonformation portion are disclosed, for example, in Jpn. Pat. Appln. KOKOKU publication No. 5-74921 and Jpn. Pat. Appln. KOKAI publication No. 8-195303. In these methods, the ring-form electrode nonformation portion is formed in the circumference portion of the nonlinear resistor by applying a rubber mask to the nonlinear resistor when the electrode is formed. Furthermore, in the method disclosed in Jpn. Pat. Appln. KOKAI publication No. 11-186006, the ring-form electrode nonformation portion is formed in the circumference portion of the nonlinear resistor such that the sintered body end portion and the electrode end portion are placed at a distance of 0.01 to 1.0 mm.

Also, in the disclosure of other numerous patent publications and various technical documents, a ring-form electrode nonformation portion is provided in the circumference portion of the nonlinear resistor. As described above, the technique that the ring-form electrode nonformation portion is provided in the circumference portion of the nonlinear resistor is widely known and has been generally employed hitherto.

With the recent remarkable development of information technology in society, the demand for an electric power has increased. In the circumstances, the electric power is demanded to be stably supplied at a low cost. In addition, there is a strong demand for miniaturizing transmission/substation appliances due to the shortage of the space for placing the transmission/substation appliances in urban areas. With the demand for stable supply of electricity to electric power systems and the demand for miniaturization, the requirement for miniaturization of the highly reliable overvoltage protection device has been increased.

To satisfy the demands, the miniaturization of the nonlinear resistor of the overvoltage protection device, has been accelerated in such a manner that the height is reduced as much as possible by increasing a voltage per unit thickness of the nonlinear resistor and the overall size is reduced by improving the energy absorbing ability. As a matter of course, even if the overvoltage protection device is miniaturized, the operation must be stably performed for a long time.

However, as is described in the conventional nonlinear resistor mentioned above, in the case where the ring-form electrode nonformation portion is provided in the circumference portion of the nonlinear resistor in such a manner that the electrode end portion is not overlapped with the sintered body end portion in order to avoid a flashover generated at the time a large current is supplied, a thermal stress generates due to the presence of the electrode nonformation portion, with the result that the sintered body may possibly be broken.

In the nonlinear resistor having an electrode formed at the upper and lower surfaces of the sintered body by forming the ring-form electrode nonformation portion in the circumference, a current flows through the electrode-formation portion when the current is supplied, whereas no current flows through the ring-form electrode nonformation portion around the periphery of the none-linear resistor. It follows that only the temperature of the electrode formation portion increases. Due to the difference in temperature between the electrode formation portion and the electrode nonformation portion, the thermal stress is produced which cracks and breaks the sintered body. As a result, there is a possibility of reducing an overvoltage protection performance of the nonlinear resistor.

Therefore, in the conventional method in which the ring-form electrode nonformation portion is formed in the circumference of the nonlinear resistor, it has been difficult to ensure sufficient protection performance against a surge such as a switching surge, lightening impulse, and overvoltage, although the sufficient protection performance is required when the non linear resistor is miniaturized by increasing the voltage per unit thickness or by reducing the diameter thereof.

To overcome such a problem, it is conceivable that the area of the electrode formation portion is enlarged as much as possible.

However, in the conventional nonlinear resistor, if the electrode is formed so as to extend to or near the side-surface high resistance layer, a flashover is generated at an interface between the sintered body and the side-surface high resistance layer. The flashover is caused by poor adhesive strength of the side-surface high resistance layer to the sintered body at the time an overvoltage surge is applied.

Alternatively, the flashover is caused by poor electric insulation characteristics or poor heat resistance of the side-surface resistance layer. Moreover, the ability of the loaded lifecycle may possibly deteriorate due to overvoltage under normal operation conditions in which a voltage is constantly applied.

Therefore, the problems residing in the conventional nonlinear resistor are that a nonlinear resistor having high overvoltage protection performance and a stable ability of a loaded lifecycle cannot be attained.

BRIEF SUMMARY OF THE INVENTION

An object of the present invention is to provide a nonlinear resistor and a method of manufacturing the nonlinear resistor which is capable of realizing a stable ability of loaded lifecycle under normal operation conditions and significantly improved its protection performance against a surge such as a switching surge, lightening impulse and overvoltage.

To attain the aforementioned object, the present invention provides a nonlinear resistor comprising a sintered body having zinc oxide as a main component;

a side-surface high resistance layer arranged at a side-surface of the sintered body; and an electrode arranged at upper and lower surfaces of the sintered body. The side-surface high resistance layer is formed of a specific material. In the nonlinear resistor, an electrode formation area is enlarged as much as possible by specifying the end-to-end distance between an end portion of the electrode and a nonlinear resistor end portion including the side-surface high resistance layer.

Since the aforementioned means is employed, it is possible to prevent occurrence of a flashover at the time overvoltage surge is applied and deterioration of the ability of a loaded lifecycle due to applied voltage under practical operation conditions.

In the present invention, it is further possible to improve the adhesion force between the electrode and the side-surface high resistance layer and the electrical characteristics by specifying an average thickness of the electrode material, the structure and thickness of the side-surface high resistance layer, or an electrode formation method.

In view of the object and the means to achieve the object, the nonlinear resistor according to claim 1 is formed in such a manner that the end-to-end distance falls within a range of 0 mm to the thickness of the side-surface high resistance layer+0.01 mm, and that the side-surface high resistance layer is formed of at least one element selected from substances containing, as a main substance, an inorganic polymer substance having electric insulating characteristics and heat resistance, an amorphous inorganic polymer substance, a glass compound, an amorphous inorganic substance, a crystalline inorganic substance, and an organic polymer compound.

In the nonlinear resistor thus constructed, by specifying the end-to-end distance within a range of 0 mm to the thickness of the side-surface high resistance layer+0.01 mm, current flows throughout the sintered body when an overvoltage surge is applied. As a result, there is no temperature difference within the nonlinear resistor. In brief, unlike the case where the ring-form electrode nonformation portion is formed around the nonlinear resistor, it is possible to prevent the occurrence of the thermal stress due to the temperature difference. As a result, the sintered body can be prevented from being broken due to the thermal stress.

Furthermore, in the nonlinear resistor, the electrode formation area is enlarged as much as possible by forming the electrode until it reaches the side-surface high resistance layer or near the interface between the sintered body and the side-surface high resistance layer. However, if the electrode formation area is enlarged to the maximum, a flashover occurs at the interface between the sintered body and the side-surface high resistance layer at the time an overvoltage surge is applied. Alternatively, the flashover occurs due to poor electric insulating characteristics and poor heat resistance of the side-surface high resistance layer. This means that the ability of a loaded lifecycle may deteriorate at the time voltage is applied under practical operation conditions.

Whereas, in the present invention, the side-surface high resistance layer is formed of at least one element selected from substances containing, as a main substance, an inorganic polymer substance having electric insulating characteristics and heat resistance, an amorphous inorganic polymer substance, a glass compound, an amorphous inorganic substance, a crystalline inorganic substance, and an organic polymer compound. Therefore, even if the electrode formation area is enlarged to the maximum, it is possible to prevent the flashover from generating at the interface between the sintered body and the side-surface high resistance layer and the flashover generated due to poor electric insulating characteristics and poor heat resistance at the time overvoltage surge is applied.

Accordingly, in the nonlinear resistor of the present invention, it is possible to attain a stable ability of a loaded lifecycle under normal operation conditions and to exhibit excellent protection performance against a surge such as a switching surge, impulse current, and overvoltage.

In particular, if the end-to-end distance is set at 0 mm, masking is not required when the electrode nonformation portion is formed, as compared to the case where the electrode nonformation portion is arranged in the circumference portion of the nonlinear resistor. Therefore, it is possible to simplify electrode formation steps.

In brief, in the present invention, in addition to the improvement in ability of a loaded lifecycle and protection performance, it is possible to simply the manufacturing steps. As a result, the manufacturing cost can be reduced.

The nonlinear resistor according to claim 2 is the nonlinear resistor according to claim 1 in which the amorphous polymer substance is an aluminum phosphate based inorganic adhesive agent which is an inorganic polymer, an amorphous silica, an amorphous alumina, or a complex of amorphous silica and organosilicate;

the glass compound is a glass containing lead as a main component, a glass containing phosphorus as a main component, or a glass containing bismuth as a main component;

the crystalline inorganic substance is a crystalline inorganic substance containing Zn—Sb—O as a constitutional component; a crystalline inorganic substance containing Zn—Si—O as a constitutional component; a crystalline inorganic substance containing Zn—Sb—Fe—O as a constitutional component; a crystalline inorganic substance containing Fe—Mn—Bi—Si—O as a constitutional component; a crystalline silica ($SiO_2$); alumina ($Al_2O_3$); mullite ($Al_6Si_2O_{13}$), cordierite ($Mg_2Al_4Si_5O_{18}$), titanium oxide ($TiO_2$), or zirconium oxide ($ZrO_2$);

the organic polymer compound is an epoxy resin, polyimide resin, phenol resin, melamine resin, fluorocarbon resin, or silicon resin; and the side-surface high resistance layer is formed of at least one type selected from the group containing the aforementioned materials and materials having a complex formed of at least two types of materials selected from the aforementioned materials, as a main component.

In the nonlinear resistor, it is possible to attain the side-surface high resistance layer having high electric insulating characteristics and heat resistance while the adhesion strength of the side-surface resistance layer to the sintered body is maintained at a predetermined level or more by appropriately selecting the material of the side-surface high resistance layer. Therefore, even if the electrode formation area is enlarged until it reaches the side-surface high resistance layer or near the interface between the sintered body and the side-surface high resistance layer, since the electric insulating properties, heat resistance and adhesive strength of the side-surface high resistance layer are high, it is possible to prevent a flashover at the interface between the sintered body and the side-surface high resistance layer caused by application of overvoltage and the flashover due to poor electric insulating characteristics and poor heat resistance. As a result, it is possible to prevent deterioration of the ability of a loaded lifecycle at the time voltage is applied under practical operation conditions.

In brief, in the nonlinear resistor, it is possible to attain a stable ability of a loaded lifecycle under normal operation conditions and to exhibit excellent protection performance against a surge such as a switching surge, impulse current and overvoltage.

The nonlinear resistor according to claim 3 is the nonlinear resistor according to either claim 1 or 2, in which the thickness of the side-surface high resistance layer falls within the range of 1 μm to 2 mm.

In the nonlinear resistor according to claim 3, it is possible to attain the side-surface high resistance layer having a high adhesion force by specifying the thickness of the side-surface high resistance layer within the range of 1 μm to 2 mm. Therefore, even if the electrode formation area is enlarged as much as possible until it reaches the side-surface high resistance layer or near the interface between the sintered body and the side-surface high resistance layer, since the adhesive strength of the side-surface high resistance layer is high, it is possible to prevent the flashover at the interface between the sintered body and the side-surface high resistance layer by application of an overvoltage surge and to prevent the deterioration of the ability of a loaded lifecycle at voltage is applied under practical operation conditions.

In brief, in the nonlinear resistor, it is possible to attain a stable ability of a loaded lifecycle under normal operation conditions and to exhibit excellent protection performance against a surge such as a switching surge, impulse current and overvoltage.

The nonlinear resistor according to claim 4 is the nonlinear resistor according to any one of claims 1 to 3, in which the shock adhesion strength of the side-surface high resistance layer to the sintered body, (which is determined by a falling ball test) falls within a range of 40 mm or more.

In general, in the nonlinear resistor, the electrode formation area is enlarged as much as possible until it reaches the side-surface high resistance layer or near the interface between the sintered body and the side-surface high resistance layer without providing ring-form electrode conformation portion in the circumference. However, even if the electrode formation area is enlarged to the maximum, the flashover may take place at the interface between the sintered body and the side-surface high resistance layer by application of the overvoltage. At the same time, the ability of a loaded life cycle may deteriorate at the time voltage is applied under practical operation conditions.

In contrast, in the present invention, by specifying the adhesion strength of the side-surface high resistance layer within an appropriate range, it is possible to prevent the flashover generating at the interface between the sintered body and the side-surface high resistance layer and to prevent the flashover caused by application of an overvoltage surge due to poor electrical insulating characteristics.

In brief, in the nonlinear resistor according to claim 4, it is possible to attain a stable ability of a loaded lifecycle under normal operation conditions and to exhibit excellent protection performance against a surge such as a switching surge, impulse current and overvoltage.

The nonlinear resistor according to claim 5 is the nonlinear resistor according to any one of claims 1 to 4, in which a material of the electrode is selected from the group consisting of aluminium, copper, zinc, nickel, gold, silver, titanium and alloys thereof.

According to the nonlinear resistor of claim 5, it is possible to attain an electrode having a high conductivity and a high adhesion force to the sintered body. It is therefore possible to exhibit excellent protection performance against a surge such as a switching surge, lightening impulse current and overvoltage.

The nonlinear resistor according to claim 6 is the nonlinear resistor according to any one of claims 1 to 5, in which an average thickness of the electrode falls within a range of 5 μm to 500 μm.

According to the nonlinear resistor of claim 5, it is possible to attain an electrode having a high adhesion strength and a heat capacity of no less than a predetermined level by specifying the average thickness of the electrode within an appropriate range of 5 μm to 500 μm. It is therefore possible to exhibit excellent protection performance against a surge such as a switching surge, lightening impulse current and overvoltage.

The method according to claim 7 is a method of forming a nonlinear resistor according to any one of claims 1 to 6, comprising:

forming a side-surface high resistance layer at a side-surface of a sintered body containing zinc oxide as a main component; and forming an electrode at upper and lower surfaces of the sintered body, in which the electrode is formed by a method selecting from the group consisting of plasma spraying, arc spraying, high-speed gas flame spraying, screen printing, deposition, transferring, and sputtering.

According to the manufacturing method mentioned above, it is possible to attain an electrode having a high adhesion force by appropriately specifying the method of forming the electrode. It is therefore possible to exhibit excellent protection performance against a surge such as a switching surge, lightening impulse current and overvoltage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, embodiments of a nonlinear resistor of the present invention and embodiments employing the manufacturing method of the present invention will be explained more specifically with reference to the accompanying drawings.

Figure 1:
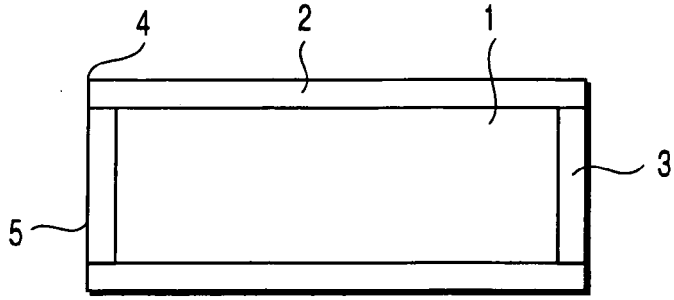
FIG. 1 is a cross-sectional view showing a nonlinear resistor manufactured according to the present invention.

FIG. 1 is a cross-sectional view showing a nonlinear resistor manufactured according to the present invention. The nonlinear resistor has a sintered body 1, an electrode 2 and a side-surface high resistance layer 3. The nonlinear resistor is manufactured by forming the side-surface high resistance layer 3 on a side-surface portion of the sintered body 1, polishing both flat surfaces of the sintered body 1 to a predetermined thickness, and forming the electrode 2 on the polished surfaces.

In the following individual embodiments, specific features reside in the electrode 2 and the side-surface high resistance layer 3. Prior to describing the specific features, the manufacturing step of the sintered body 1 will be described.

[Manufacturing Step of Sintered Body]

In the first place, bismuth oxide ($Bi_2O_3$) and manganese oxide ($MnO_2$) (0.5 mol % for each) and cobalt oxide ($Co_2O_3$), nickel oxide (NiO) and antimony oxide ($Sb_2O_3$) (1 mol % for each) are added as sub components to a main component, ZnO (zinc oxide) to form a raw material.

The raw material is then mixed with water and organic binders in a blender to obtain a slurry mixture.

Subsequently, the slurry mixture is granulated by a spray dryer. A predetermined weight of the granulated powder is placed in a mold and pressurized at a predetermined pressure to mold into a disk of e.g., 60 mm in diameter.

Thereafter, to remove the added organic binders in advance, the disk is treated with heat at 400–500° C. in air and further sintered at 1200° C. to obtain the sintered body 1.

(First Embodiment)

The first embodiment relates to the invention according to claim 1. As samples, a plurality of nonlinear resistors having a side-surface high resistance layer which was formed of a material selected from predetermined materials, were formed by varying the distance (end-to-end distance) between an electrode end portion 4 and a nonlinear resistor end portion 5 including a side-surface high resistance layer within the range of 0 mm to the thickness of the side-surface high resistance layer+0.01 mm. Individual samples were evaluated for functional effects. Note that the case where the end-to-end distance between an electrode end portion 4 and a nonlinear resistor end portion 5 including a side-surface high resistance layer is 0 is shown in FIG. 1. In other words, the end portion 4 is in line with the end portion 5.

[Preparation of Samples Different in End-to-end Distance]

To show the functional effect produced by the structure in which the end-to-end distance fell within the range of 0 mm to the thickness of the side-surface resistance layer+0.01 mm, a plurality of types of nonlinear resistors having different end-to-end distances were formed by varying an area in which the electrode 2 was to be formed.

In any one of the samples, the side-surface high resistance layer 3 of 100 μm thick was formed of a mullite ($Al_6Si_2O_{13}$)-containing phosphorus aluminium based inorganic adhesive agent serving as a main component.

On the samples each having the side-surface high resistance layer 3 of 100 μm-thick, electrodes 2 having different areas were formed by an aluminum-containing material as a main component. In this way, 7 types of nonlinear resistors were formed having different end-to-end distances of 0, 10, 50, 100, 110, 120, and 150 μm.

[Evaluation of Samples Different in End-to-end Distance]

To the samples thus manufactured, a switching surge (having a predetermined energy at a 2 ms wavelength) was applied starting from 100 J/cm$^3$ as an initial application energy while an application energy was increased by 50 J/cm$^3$ every time the temperature of each of the samples returned to room temperature. The overvoltage protection performance of each sample was evaluated on the basis of the breakage energy at which the sample was broken. The results are shown in FIG. 2.

Figure 2:
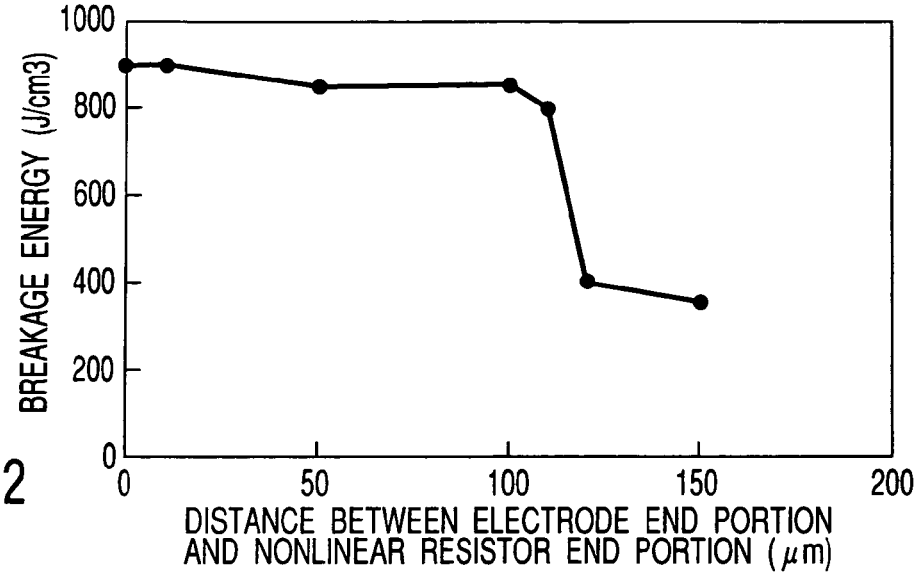
FIG. 2 is a graph showing the relationship between the overvoltage protection performance and the end-to-end distance between an electrode end portion and end portion of the nonlinear resistor including the side-surface high resistance layer, with respect to the nonlinear resistor manufactured in accordance with a first embodiment.

As is apparent from FIG. 2, in any one of the samples in accordance with the present invention, that is, the samples having an end-to-end distance within the range of 0 mm to the thickness of the side-surface high resistance layer+0.01 mm (in this embodiment, the end-to-end distance was 0–110 μm), no breakage is observed at the time the switching surge having an energy of less than 800 J/cm$^3$ is applied. The breakage occurs at the time the application energy having at least 800 J/cm$^3$ is applied.

In contrast, in the samples outside the scope of the present invention, that is, the sample having an end-to-end distance larger than the thickness of the side-surface resistance layer+0.01 mm (in this embodiment, the end-to-end distance exceeds 110 μm), the breakage occurs when the switching surge having an energy of 400 J/cm$^3$ or less is applied.

The reason why the aforementioned evaluation was resulted can be interpreted as follows. If the end-to-end distance is as large as more than the thickness of the side-surface resistance layer+0.01 mm, the area of a no-current flowing region around the nonlinear resistor is increased when the switching surge is applied. As a result, the temperature of the no-current flowing region differs from that of the current-flowing region, so that thermal stress is produced. Because of the thermal stress, the sintered body 1 is cracked and broken, with the result that the overvoltage protection performance of the nonlinear resistor is lowered.

In contrast, if the end-to-end distance falls within the range of 0 mm to the thickness of the side-surface resistance layer+0.01 mm, the no-current flowing region is not produced around the nonlinear resistor when the switching surge is supplied. If produced, the non-current flowing region is small. As a result, there is no temperature difference in the nonlinear resistor. It is therefore possible to prevent the breakage of the sintered body 1 due to the thermal stress.

For reasons mentioned above, it is impossible to obtain excellent overvoltage protection performance in the nonlinear resistor having the end-to-end distance larger than the thickness of the side-surface resistance layer+0.01 mm. The excellent overvoltage protection performance is obtained only in the nonlinear resistors having the end-to-end distance within the thickness of the side-surface resistance layer+0.01 mm.

[Effects Produced by Varying End-to-end Distance]

As is apparent from the evaluation results mentioned above, if the nonlinear resistor is formed by specifying a predetermined side-surface high resistance layer 3 in accordance with the present invention such that the end-to-end distance falls within the range of 0 mm to the thickness of side-surface resistance layer+0.01 mm, it is possible to attain a stable ability of a loaded lifecycle when the operation is made under normal conditions, and it is also possible to greatly improve the overvoltage protection performance against a surge such as a switching surge, impulse current, and overvoltage.

(Second Embodiment)

Second embodiment relates to inventions according to claims 1 and 2. A nonlinear resistor was formed such that the end-to-end distance fell within the range of 0 mm to the thickness of the side-surface resistance layer+0.01 mm, and that the side-surface high resistance layer is formed of at least one type selected from the group consisting of, as a main component, a side-surface high resistance layer formed of an inorganic polymer having electric insulating characteristics and heat resistance, a side-surface high resistance layer formed of an amorphous inorganic polymer, a side-surface high resistance layer formed of a glass compound, a side-surface high resistance layer formed of an amorphous inorganic substance, a side-surface high resistance layer made of a crystalline inorganic substance, and a side-surface high resistance layer made of an organic polymer resin.

More specifically, the side-surface high resistance layer of the nonlinear resistor was formed of at least one type material selected from the group consisting of amorphous inorganic polymers such as aluminum phosphate based inorganic adhesive agent (inorganic polymer), amorphous silica, amorphous alumina, amorphous silica and organosilicate, and amorphous alumina and organosilicate;

glass compounds such as a glass containing lead as a main component, a glass containing phosphorus as a main component, and a glass containing bismuth as a main component;

crystalline inorganic substances such as a crystalline inorganic substance containing Zn—Sb—O as a constitutional component, a crystalline inorganic substance containing Zn—Si—O as a constitutional component, a crystalline inorganic substance having Zn—Sb—Fe—O as a constitutional component, a crystalline inorganic substance having Fe—Mn—Bi—Si—O as a constitutional component, a crystalline silica ($SiO_2$), alumina ($Al_2O_3$), mullite ($Al_6Si_2O_{13}$), cordierite ($Mg_2Al_4Si_5O_{18}$), titanium oxide ($TiO_2$), and zirconium oxide ($ZrO_2$);

organic polymer compounds such as epoxy resin, polyimide resin, phenol resin, melamine resin, fluorocarbon resin, and silicon resin; and a mixture consisting of at least two types of materials selected from the above.

A plurality of nonlinear resistors having different side-surface high resistance layers in constitution were formed as mentioned above and they were evaluated for functional effects. In this manner, the functional effects of the nonlinear resistors formed by specifying the constitution of the side-surface high resistance layer were evaluated.

[Preparation of Samples by Varying the Side-surface High Resistance Layer in Constitution]

As the nonlinear resistor having a single-layered side-surface high resistance layer, the following 38 types of nonlinear resistors (Samples 1–38) were manufactured in accordance with the present invention.

Sample 1 to 4: 4 types nonlinear resistors having a side-surface high resistance layer 3 made of an inorganic polymer;

Sample 5 to 8: 4 types nonlinear resistors having a side-surface high resistance layer 3 made of an amorphous inorganic polymer;

Sample 9 to 17: 9 types nonlinear resistors having a side-surface high resistance layer 3 made of a glass compound;

Sample 18 to 29: 12 types nonlinear resistors having a side-surface high resistance layer 3 made of a crystalline inorganic substance; and Sample 30–38: 9 types nonlinear resistors having a side-surface high resistance layer 3 made of an organic polymer resin having electric insulating characteristics and heat resistance.

More specifically, the side-surface high resistance layers 3 of Samples 1 to 38 are formed as follows:

In Samples 1 to 4, as the side-surface high resistance layer 3 of an inorganic polymer, the followings were formed:

a side-surface high resistance layer 3 having a mullite ($Al_6Si_2O_{13}$)-containing aluminium inorganic adhesive agent as a main component;

a side-surface high resistance layer 3 having an alumina ($Al_2O_3$)-containing aluminium phosphate based inorganic adhesive agent as a main component;

a side-surface high resistance layer 3 having a silica ($SiO_2$)-containing aluminium phosphate based inorganic adhesive agent as a main component; and a side-surface high resistance layer 3 having a cordierite ($Mg_2Al_4Si_5O_{18}$)-containing aluminum phosphate based inorganic adhesive agent as a main component.

In Samples 5–8, as the side-surface high resistance layer 3 of an amorphous inorganic polymer, the followings were formed:

a side-surface high resistance layer 3 containing amorphous silica ($SiO_2$) as a main component;

a side-surface high resistance layer 3 containing amorphous alumina ($Al_2O_3$) as a main component;

a side-surface high resistance layer 3 containing amorphous silica ($SiO_2$) and organosilicate ($CH_3SiO_{1.5}$) as a main component; and a side-surface high resistance layer 3 containing amorphous alumina ($Al_2O_3$) and organosilicate ($CH_3SiO_{1.5}$) as a main component.

In Samples 9–17, as the side-surface high resistance layer 3 of an amorphous inorganic substance, the followings were formed:

a side-surface high resistance layer 3 containing a Pb—B—Si glass as a main component;

a side-surface high resistance layer 3 containing a Pb—Zn—B—Si glass as a main component;

a side-surface high resistance layer 3 containing a Pb—Si—B glass as a main component;

a side-surface high resistance layer 3 containing a Pb—Si—Zn glass as a main component;

a side-surface high resistance layer 3 containing a Pb—Sn—Zn—Al—Si glass as a main component;

a side-surface high resistance layer 3 containing a Bi—B—Si glass as a main component;

a side-surface high resistance layer 3 containing a Bi—Zn—B—Si glass as a main component;

a side-surface high resistance layer 3 containing a Bi—Zn—B—Si—Al glass as a main component; and a side-surface high resistance layer 3 containing a Bi—Zn—B—Al glass as a main component.

In Samples 18–29, as the side-surface high resistance layer 3 of an amorphous inorganic substance, the followings were formed:

a side-surface high resistance layer 3 containing a crystalline inorganic substance having Zn—Sb—O as a main component;

a side-surface high resistance layer 3 containing a crystalline inorganic substance having Zn—Si—O as a main component;

a side-surface high resistance layer 3 containing a complex of a crystalline inorganic substance having Zn—Si—O and a crystalline inorganic substance having Zn—Sb—O as a main component;

a side-surface high resistance layer 3 containing a complex of a crystalline inorganic substance having Zn—Si—O and a crystalline inorganic substance having Fe—Zn—Sb—O as a main component;

a side-surface high resistance layer 3 containing a crystalline inorganic substance having Fe—Mn—Bi—Si—O, as a main component;

a side-surface high resistance layer 3 containing a complex of a crystalline inorganic substance having Fe—Mn—Bi—Si—O and a crystalline inorganic substance having Zn—Sb—O as a main component;

a side-surface high resistance layer 3 containing amorphous silica ($SiO_2$) as a main component;

a side-surface high resistance layer 3 containing alumina ($Al_2O_3$) as a main component;

a side-surface high resistance layer 3 containing mullite ($Al_6Si_2O_{13}$) as a main component;

a side-surface high resistance layer 3 containing cordierite ($Mg_2Al_4Si_5O_{18}$) as a main component;

a side-surface high resistance layer 3 containing titanium oxide ($TiO_2$) as a main component; and a side-surface high resistance layer 3 containing zirconium oxide ($ZrO_2$) as a main component.

In Samples 30–38, as the side-surface high resistance layer 3 of an organic polymer resin having electric insulating characteristics and heat resistance, the followings were formed:

a side-surface high resistance layer 3 containing an epoxy resin as a main component;

a side-surface high resistance layer 3 containing silica as a main component;

a side-surface high resistance layer 3 containing alumina as a main component;

a side-surface high resistance layer 3 containing silica and alumina as a main component;

a side-surface high resistance layer 3 containing a polyimide resin as a main component;

a side-surface high resistance layer 3 containing a phenol resin as a main component;

a side-surface high resistance layer 3 containing a melamine resin as a main component;

a side-surface high resistance layer 3 containing a fluorocarbon resin as a main component; and a side-surface high resistance layer 3 containing a silicon resin as a main component.

Furthermore, for comparison, 5 types of nonlinear resistors (Samples 39–43) were formed, which had a side-surface high resistance layer of an organic polymer resin low in electric insulating characteristics and in heat resistance, as a main component.

In Samples 39–43, as the side-surface high resistance layer containing an organic polymer resin low in electric insulating characteristics and in heat resistance, as a main component, the followings were formed:

a side-surface high resistance layer 3 containing a Teflon resin as a main component;

a side-surface high resistance layer 3 containing a polyethylene resin as a main component;

a side-surface high resistance layer 3 containing a polystyrene resin as a main component;

a side-surface high resistance layer 3 containing a polypropylene resin as a main component; and a side-surface high resistance layer 3 containing an acrylic resin as a main component.

Three types of nonlinear resistors (Samples 44–46) were formed which had a side-surface high resistance layer containing a rubber as a main component. In Samples 44–46, as the side-surface high resistance layer containing a rubber as a main component, the followings were employed:

a side-surface high resistance layer 3 containing a fluorine rubber as a main component;

a side-surface high resistance layer 3 containing a urethane rubber as a main component; and a side-surface high resistance layer 3 containing a silicone rubber as a main component.

Furthermore, 12 types of nonlinear resistors (Samples 47–58) were manufactured as the nonlinear resistor having a dual-layered side-surface high resistance layer. More specifically, the 12 types of nonlinear resistors were formed by combining 2 types of side-surface high resistance layers selected from 6 types of side-surface high resistance layers specified by the present invention. The side-surface high resistance layers 3 of Samples 47–58 are as follow:

In Sample 47, a second side-surface high resistance layer containing amorphous silica ($SiO_2$) and organosilicate ($CH_3SiO_{1.5}$) was formed on a first side-surface high resistance layer formed of a mullite ($Al_6Si_2O_{13}$)-containing aluminium phosphate based inorganic adhesive, as a main component, thereby forming a dual-layer side-surface high resistance layer 3.

In Sample 48, a second side-surface high resistance layer containing amorphous alumina ($Al_2O_3$), and organ silicate ($CH_3SiO_{1.5}$) as a main component was formed on a first side-surface high resistance layer formed of a mullite ($Al_6Si_2O_{13}$)-containing aluminium phosphate based inorganic adhesive as a main component, thereby forming a dual-layer side-surface high resistance layer 3.

In Sample 49, a second side-surface high resistance layer containing amorphous silica ($SiO_2$), and organosilicate ($CH_3SiO_{1.5}$) as a main component was formed on a first side-surface high resistance layer formed of an alumina ($Al_2O_3$)-containing aluminium phosphate based inorganic adhesive as a main component, thereby forming a dual-layer side-surface high resistance layer 3.

In Sample 50, a second side-surface high resistance layer containing amorphous alumina ($Al_2O_3$) and organosilicate ($CH_3SiO_{1.5}$) as a main component was formed on a first side-surface high resistance layer formed of an alumina ($Al_2O_3$)-containing aluminium phosphate based inorganic adhesive as a main component, thereby forming a dual-layer side-surface high resistance layer 3.

In Sample 51, a second side-surface high resistance layer containing amorphous silica ($SiO_2$), and organosilicate ($CH_3SiO_{1.5}$) as a main component was formed on a first side-surface high resistance layer formed of a complex consisting of a crystalline inorganic substance of a Zn—Si—O component and a crystalline inorganic substance of a Zn—Sb—O component, as a main component, thereby forming a dual-layer side-surface high resistance layer 3.

In Sample 52, a second side-surface high resistance layer containing Pb—B—Si glass as a main component was formed on a first side-surface high resistance layer formed of a complex consisting of a crystalline inorganic substance of a Zn—Si—O component and a crystalline inorganic substance of a Zn—Sb—O component, as a main component, thereby forming a dual-layer side-surface high resistance layer 3.

In Sample 53, a second side-surface high resistance layer containing Pb—Zn—B—Si glass as a main component was formed on a first side-surface high resistance layer formed of a complex consisting of a crystalline inorganic substance of a Zn—Si—O component and crystalline inorganic substance of a Zn—Sb—O component, as a main component, thereby forming a dual-layer side-surface high resistance layer 3.

In Sample 54, a second side-surface high resistance layer containing Bi—B—Si glass as a main component was formed on a first side-surface high resistance layer formed of a complex consisting of a crystalline inorganic substance of a Zn—Si—O component and a crystalline inorganic substance of a Zn—Sb—O component, as a main component, thereby forming a dual-layer side-surface high resistance layer 3.

In Sample 55, a second side-surface high resistance layer containing Bi—Zn—B—Si glass as a main component was formed on a first side-surface high resistance layer formed of a complex consisting of a crystalline inorganic substance of a Zn—Si—O component and a crystalline inorganic substance of a Zn—Sb—O component, as a main component, thereby forming a dual-layer side-surface high resistance layer 3.

In Sample 56, a second side-surface high resistance layer containing an epoxy resin as a main component was formed on a first side-surface high resistance layer formed of a complex consisting of a crystalline inorganic substance of a Zn—Si—O component and a crystalline inorganic substance of a Zn—Sb—O component, as a main component, thereby forming a dual-layer side-surface high resistance layer 3.

In Sample 57, a second side-surface high resistance layer containing an amorphous silica ($SiO_2$) and organosilicate ($CH_3SiO_{1.5}$), as a main component was formed on a first side-surface high resistance layer formed of alumina ($Al_2O_3$), thereby forming a dual-layer side-surface high resistance layer 3.

In Sample 58, a second side-surface high resistance layer containing amorphous silica ($SiO_2$) and organosilicate ($CH_3SiO_{1.5}$), as a main component was formed on a first side-surface high resistance layer formed of mullite ($Al_6Si_2O_{13}$) as a main component, thereby forming a dual-layer side-surface high resistance layer 3.

In either sample, the electrode 2 was formed of a material containing aluminium as a main component such that the end-to-end distance was set at 0 mm.

[Evaluation of Samples having a Side-surface High Resistance Layer Different in Constitution]

To each of the samples manufactured in the manner as mentioned above, a switching surge (having a predetermined energy at 2 ms wavelength) was applied starting from 100 J/cm$^3$ while an application energy was increased by 50 J/cm$^3$ every time the temperature of the sample returned to room temperature. The overvoltage protection performance of each sample was evaluated on the basis of the breakage energy at which the sample was broken. Furthermore, to the nonlinear resistor placed under a temperature of 115° C. of each sample, an alternative voltage (1 mA (current IR) flows through a nonlinear resistor at room temperature) was applied for 1000 hours. Then, a leakage current (IR (0 h)) was measured immediately after initiation of the current application. Furthermore, current IR (1000 h) was measured after voltage was applied for 1000 hours. The ability of a loaded lifecycle was evaluated by a value of IR (1000 h)/IR (0 h). The evaluation results are shown in Tables 1 and 2.

TABLE 1

Relationship between material of side surface resistance layer/overvoltage protective performance ability of loaded lifecycle

| Sample No. | Classification of side surface high resistance layer | First side surface high resistance layer | Second side surface high resistance layer | Destruction energy ($J/cm^3$) | $IR_{0h}/IR_{1000h}$ |
|---|---|---|---|---|---|
| 1 | Inorganic polymer | Mullite-containing aluminum phosphate based inorganic adhesive agent | | 850 | 0.93 |
| 2 | | Alumina-containing aluminum phosphate based inorganic adhesive agent | | 800 | 0.91 |
| 3 | | Silica-containing aluminum phosphate based inorganic adhesive agent | | 800 | 0.89 |
| 4 | | Cordierite-containing aluminum phosphate based in organic adhesive agent | | 850 | 0.87 |
| 5 | Amorphous inorganic polymer | Amorphous silica | | 850 | 0.87 |
| 6 | | Amorphous alumina | | 800 | 0.85 |
| 7 | | Amorphous silica and organosilicate | | 850 | 0.91 |
| 8 | | Amorphous alumina and organosilicate | | 800 | 0.92 |
| 9 | Glass compound | Pb—B—Si glass | | 850 | 0.86 |
| 10 | | Pb—Zn—B—Si glass | | 800 | 0.89 |
| 11 | | P—Si—B glass | | 800 | 0.92 |
| 12 | | Pb—Si—Zn glass | | 800 | 0.87 |
| 13 | | P—Sn—Zn—Al—Si glass | | 800 | 0.86 |
| 14 | | Bi—B—Si glass | | 850 | 0.90 |
| 15 | Glass compound | Bi—Zn—B—Si glass | | 850 | 0.89 |
| 16 | | Bi—Zn—B—Si—Al glass | | 800 | 0.93 |
| 17 | | Bi—Zn—B—Al glass | | 800 | 0.95 |
| 18 | Crystalline inorganic substance | Zn—Sb—O crystalline inorganic substance | | 800 | 0.91 |
| 19 | | Zn—Si—O crystalline inorganic substance | | 800 | 0.90 |
| 20 | | Zn—Si—O crystalline inorganic substance + Zn—Sb—O crystalline inorganic substance | | 850 | 0.94 |
| 21 | | Zn—Si—O crystalline inorganic substance + Fe—Zn—Sb—O crystalline inorganic substance | | 800 | 0.88 |
| 22 | Crystalline inorganic substance | Fe—Mn—Bi—Si—O crystalline inorganic substance | | 800 | 0.87 |
| 23 | | Fe—Mn—Bi—Si—O crystalline inorganic substance + Zn—Sb—O crystalline inorganic substance | | 850 | 0.89 |
| 24 | | Crystalline silica | | 800 | 0.86 |
| 25 | | Alumina | | 800 | 0.85 |
| 26 | | Mullite | | 850 | 0.87 |
| 27 | | Cordierite | | 800 | 0.89 |
| 28 | | Titanium oxide | | 800 | 0.88 |
| 29 | | Zirconium oxide | | 800 | 0.89 |

TABLE 2

Relationship between material of side surface resistance layer/overvoltage protective performance ability of loaded lifecycle

| Sample No. | Classification of surface high resistance layer | First side surface high resistance layer | Second side surface high resistance layer | Destruction energy ($J/cm^3$) | $IR_{0h}/IR_{1000h}$ |
|---|---|---|---|---|---|
| 30 | Organic polymer resin high in electric insulating properties and heat resistance | Epoxy resin | | 850 | 0.86 |
| 31 | | Silica-containing epoxy resin | | 850 | 0.93 |
| 32 | | Alumina-containing epoxy resin | | 850 | 0.90 |
| 33 | | Silica/alumina-containing epoxy resin | | 900 | 0.89 |
| 34 | | Polymide resin | | 800 | 0.91 |
| 35 | | Phenol resin | | 800 | 0.93 |
| 36 | | Melamine resin | | 800 | 0.89 |
| 37 | | Fluorocarbon resin | | 850 | 0.90 |
| 38 | | Silicon resin | | 850 | 0.86 |
| 39 | Organic polymer resin high in electric insulating properties and heat resistance | Teflon resin | | 350 | 1.56 |
| 40 | | Polyethylene resin | | 300 | 2.13 |
| 41 | | Polystyrene resin | | 300 | 2.47 |
| 42 | | Polypropylene resin | | 250 | 2.91 |
| 43 | | Acrylic resin | | 300 | 2.57 |
| 44 | Organic polymer | Fluorocarbon rubber | | 400 | 1.98 |

TABLE 2-continued

| Relationship between material of side surface resistance layer/overvoltage protective performance ability of loaded lifecycle | | | | | |
|---|---|---|---|---|---|
| Sample No. | Classification of surface high resistance layer | First side surface high resistance layer | Second side surface high resistance layer | Destruction energy ($J/cm^3$) | $IR_{0h}/IR_{1000h}$ |
| 45 | rubber | Urethane rubber | | 350 | 1.72 |
| 46 | | Silicon rubber | | 300 | 2.97 |
| 47 | Combination of two types of side surface high resistance layer | Mullite-containing aluminium phosphate based inorganic adhesive agent | Amorphous silica and organosilicate | 950 | 0.97 |
| 48 | | Mullite-containing aluminium phosphate based inorganic adhesive agent | Amorphous Alumina and organosilicate | 950 | 0.95 |
| 49 | | Alumina-containing aluminium phosphate based inorganic adhesive agent | Amorphous silica and organosilicate | 900 | 0.91 |
| 50 | | Alumina-containing aluminium phosphate based inorganic adhesive agent | Amorphous Alumina and organosilicate | 900 | 0.89 |
| 51 | Combination of two types of side surface high resistance layer | Zn—Si—O crystalline inorganic substance + Zn—Sb—O crystalline inorganic substance | Amorphous silica and organosilicate | 850 | 0.94 |
| 52 | | Zn—Si—O crystalline inorganic substance + Zn—Sb—O crystalline inorganic substance | Pb—B—Si glass | 900 | 0.98 |
| 53 | | Zn—Si—O crystalline inorganic substance + Zn—Sb—O crystalline inorganic substance | Pb—Zn—B—Si glass | 900 | 0.87 |
| 54 | | Zn—Si—O crystalline inorganic substance + Zn—Sb—O crystalline inorganic substance | Bi—B—Si glass | 950 | 0.88 |
| 55 | Combination of two types of side surface high resistance layer | Zn—Si—O crystalline inorganic substance + Zn—Sb—O crystalline inorganic substance | Bi—Zn—B—Si glass | 950 | 0.89 |
| 56 | | Zn—Si—O crystalline inorganic substance + Zn—Sb—O crystalline inorganic substance | Epoxy resin | 850 | 0.93 |
| 57 | | Alumina | Amorphous silica and organosilicate | 850 | 0.89 |
| 58 | | Mullite | Amorphous silica and organosilicate | 850 | 0.95 |

As is apparent from Tables 1 and 2, in Samples 1–38 and Samples 47–58 using the side-surface high resistance layer of the present invention, no breakage occurs when the switching surge having an energy of less than 800 $J/cm^3$ is applied. The breakage occurs when the switching surge having an energy of no less than 800 $J/cm^3$ is applied. In contrast, in Samples 39 to 46, which are the samples outside the scope of the present invention, the breakage occurs when the switching surge having an energy of not more than 400 $J/cm^3$ is applied.

The reason why the aforementioned evaluation was resulted, can be interpreted as follows. Since the side-surface high resistance layer 3 having a high shock adhesive strength, high electric insulating characteristics, and high heat resistance can be easily attained by using the side-surface high resistance layer 3 according to the present invention, it is possible to obtain excellent overvoltage protection performance. In contrast, in the case where the side-surface high resistance layer 3 outside the scope of the present invention, it is difficult to obtain the side-surface high resistance layer 3 having a high shock adhesive strength, high electric insulating characteristics, and high heat resistance. Therefore, a flashover easily takes place at the interface between the side-surface resistance layer 3 and the sintered body 1 when the switching surge is applied. Hence, it is impossible to obtain excellent overvoltage protection performance.

In any one of Samples 1 to 38, and 47–58 employing the side-surface high resistance layer of the present invention, the value of IR (1000 h)/IR (0 h) exhibits 1 or less, whereas, in Samples 39–46 employing the side-surface high resistance layer outside the scope of the present invention, the value of IR (1000 h)/IR (0 h) is far larger than 1.

The reasons why the evaluation mentioned above are resulted can be interpreted as follows. When the formation area of the electrode 2 is enlarged as much as possible until it reaches the side-surface high resistance layer 3 or it reaches near the interface between the sintered body 1 and the side-surface high resistance layer 3, a leakage current flowing through the interface between the side-surface high resistance layer 3 and the sintered body 1 is increased by applying voltage for a long time unless the side-surface high resistance layer of the present invention is used. In contrast, if the side-surface high resistance layer of the present invention is used, the leakage current flowing through the interface between the side-surface high resistance layer 3 and the sintered body 1 is not increased even if voltage is applied for a long time in the case where the formation area of the electrode 2 is enlarged as much as possible.

Therefore, in the nonlinear resistor employing the side-surface high resistance layer outside the scope of the present invention, a stable ability of a loaded lifecycle cannot be obtained. It is therefore conceivable that the stable ability of a loaded lifecycle can be obtained only in the nonlinear resistor using the side-surface high resistance layer according to the present invention.

[Effect Produced by Varying the Side-surface High Resistance Layer in Constitution]

As is apparent from the aforementioned results, if the side-surface high resistance layer is formed by using at least one selected from 6 types of side-surface high resistance layers according to the present invention, including:

a side-surface high resistance layer formed of an inorganic polymer having electric insulating characteristics and heat resistance, a side-surface high resistance layer formed of an amorphous inorganic polymer, a side-surface high resistance layer formed of an amorphous inorganic substance, a side-surface high resistance layer formed of a glass compound, a side-surface high resistance layer formed of a crystalline inorganic substance, and a side-surface high resistance layer formed mainly of an organic polymer resin, a stable ability of a loaded lifecycle can be attained when it is used under normal operation conditions and the overvoltage protection performance against the surge such as switching surge, impulse current and overvoltage, can be greatly improved.

(Third Embodiment)

The third embodiment relates to the invention according to claim 3. To show the functional effects produced by further varying the thickness of the side-surface high resistance layer in addition to the case of the first embodiment where the material of the side-surface resistance layer and the end-to-end distance are varied, a plurality of types of nonlinear resistors were manufactured as samples by varying the thickness of the side surface resistance layer, and then, subjected to evaluation.

The nonlinear resistors according to this embodiment were basically formed such that the end-to-end distance between the electrode end portion 4 and nonlinear resistor end portion 5 including the side-surface high resistance layer was set at a predetermined value within the range of 0 mm to the thickness of the side-surface high resistance layer+0.01 mm. In addition to this structure, the side-surface high resistance layers 3 having different thicknesses within the range of 1 μm to 2 mm were formed. In this manner, a plurality of nonlinear resistors according to claim 3 of the present invention were prepared as samples. Thereafter, the samples were evaluated for functional effects.

[Preparation of Samples having a Side-surface High Resistance Layer Different in Average Thickness]

Seven types of nonlinear resistors having a side-surface high resistance layer 3 formed of a mullite ($Al_6Si_2O_{13}$)-containing aluminium phosphate adhesive agent were formed with thicknesses of 0.1, 1, 10, 100 μm, 1, 2, and 5 mm.

Furthermore, in all samples, the electrode 2 was formed by using aluminium as a main component such that the end-to-end distance was 0 mm.

[Evaluation of Samples having a Side-surface High Resistance Layer Different in Thickness]

In the samples thus manufactured, the switching surge (a predetermined energy at 2 ms wavelength) was applied starting from 100 J/cm$^3$ as an initial energy while increasing the application energy by 50 J/cm$^3$ every time each of the samples returned to room temperature. The breakage energy at which the sample was broken was measured to evaluate its overvoltage protection performance. The results are shown in FIG. 3.

Figure 3:
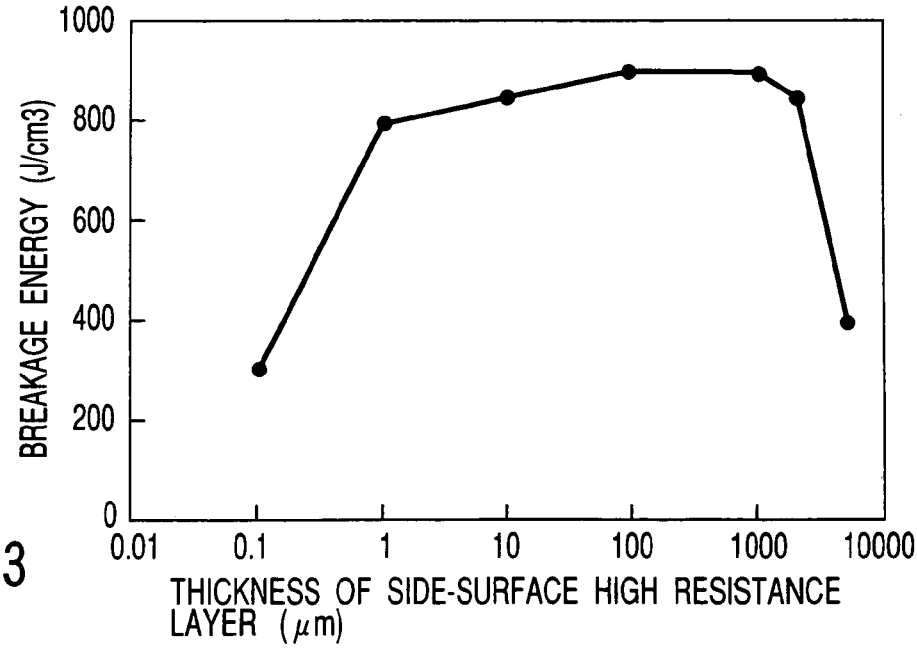
FIG. 3 is a graph showing the relationship between the thickness of the side-surface high resistance layer and the overvoltage protection performance, with respect to the nonlinear resistor manufactured in accordance with a third embodiment.

As is apparent from FIG. 3, in the samples according to the present invention, that is, the samples of the side-surface high resistance layers 3 having a thickness within the range of 1 μm to 2 mm, no breakage occurs at the time the switching surge having an energy of less than 800 J/cm$^3$ is applied. The breakage occurs when the applied energy is at least 800 J/cm$^3$. In contrast, in the samples outside the scope of the present invention, that is, samples of side-surface high resistance layers 3 having thicknesses of 0.1 μm and 5 mm, the breakage occurs when the switching surge having an energy of not more than 400 J/cm$^3$ is applied.

The reason why the aforementioned evaluation was resulted can be interpreted as follows. When the thickness of the side-surface high resistance layer 3 is as thin as less than 1 μm, it is impossible to obtain appropriate electric insulating characteristics. As a result, excellent overvoltage protection performance cannot be obtained. On the other hand, when the side-surface high resistance layer 3 is as thick as more than 2 mm, the adhesive strength of the side-surface resistance layer 3 to the sintered body 1 decreases. As a result, excellent overvoltage protection performance cannot be obtained. In contrast, if the thickness of the side-surface high resistance layer 3 falls within the range of 1 μm to 2 mm, electric insulating characteristics can be ensured at a predetermined level or more. In addition, the adhesive strength of the side-surface high resistance layer 3 to the sintered body 1 can be maintained at a predetermined level or more. As a result, excellent overvoltage protection performance can be obtained.

To the nonlinear resistor of each of the samples mentioned above, an alternative voltage (current IR, 1 mA flows through a nonlinear resistor at room temperature) was applied under a temperature of 115° C., for 1000 hours. Then, a leakage current (IR (0 h)) was measured immediately after the current application was initiated. Furthermore, current IR (1000 h) was measured after voltage was applied for 1000 hours. The value of IR (1000 h)/IR (0 h) was calculated to evaluate the ability of a loaded lifecycle. The evaluation results are shown in FIG. 4.

Figure 4:
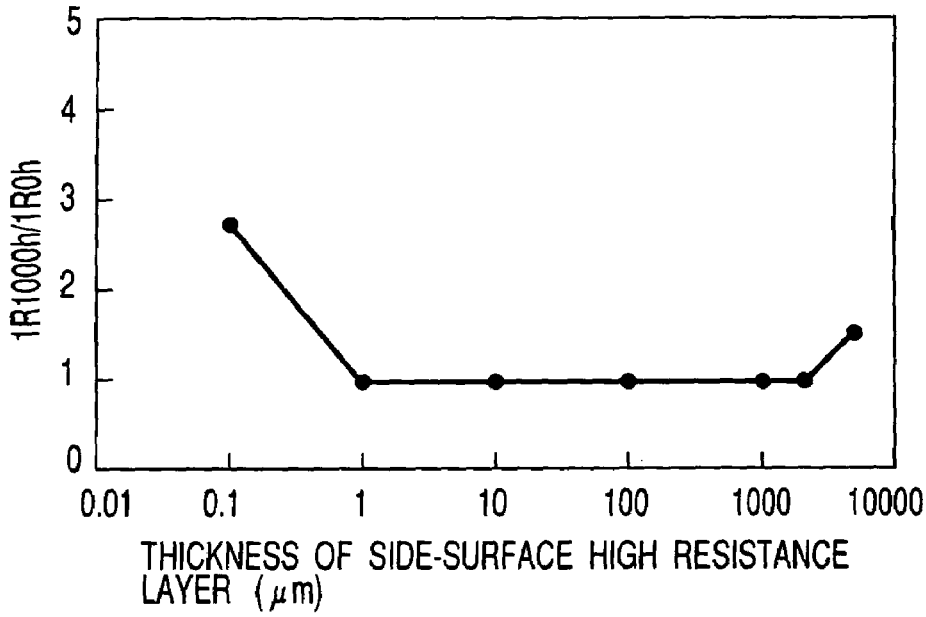
FIG. 4 is a graph showing the relationship between the thickness of the side-surface high resistance layer and ability of a loaded lifecycle, with respect to the nonlinear resistor manufactured in accordance with a third embodiment.

As is apparent from FIG. 4, in the samples of the present invention having the side-surface high resistance layer 3 having a thickness within 1 μm to 2 mm, the value of IR (1000 h)/IR (0 h) exhibits 1 or less, whereas, in samples outside the scope of the third embodiment having the side-surface high resistance layers 3 of 0.1 μm and 5 mm thick, the value of IR (1000 h)/IR (0 h) is far larger than 1.

The reason why the aforementioned evaluation was resulted can be interpreted as follows. When the formation area of the electrode 2 is enlarged as much as possible until it reaches the side-surface high resistance layer 3 or it reaches near the interface between the sintered body 1 and the side-surface high resistance layer 3, if the thickness of the side-surface high resistance layer 3 is as thin as 1 μm or less, a leakage current flowing through the interface between the side-surface high resistance layer 3 and the sintered body 1 increases. As a result, a stable ability of a loaded lifecycle cannot be obtained.

Conversely, when the thickness of the side-surface high resistance layer 3 is as thick as more than 2 mm, the adhesive strength of the side-surface high resistance layer 3 to the sintered body 1 decreases. As the result, a leakage current flowing through the interface between the side-surface high resistance layer 3 and the sintered body 1 increases when voltage is applied for a long time. Therefore, a stable ability of a loaded lifecycle cannot be obtained.

In contrast, when the formation area of the electrode 2 is enlarged as much as possible, if the thickness of the side-surface high resistance layer 3 falls within the range of 1 μm to 2 mm, a leakage current flowing through the interface between the surface of the side-surface high resistance layer 3 and the sintered body 1 does not increase.

Therefore, in the nonlinear resistors having a side-surface high resistance layer whose thickness is less than 1 μm or more than 2 mm, a stable ability of a loaded lifecycle cannot be obtained. The stable ability of a loaded lifecycle can be obtained only in the nonlinear resistor having a side-surface high resistance layer having a thickness within the range of 1 μm to 2 mm.

[Effect Produced by Varying Thickness of the Side-surface High Resistance Layer]

As is apparent from the evaluation results mentioned above, if the thickness of the side-surface high resistance layer 3 is set at a value within the range of 1 μm to 2 mm according to the present invention, it is possible to ensure both voltage resistance and an appropriate adhesive strength at a predetermined level or more. Therefore, it is possible to attain a stable ability of a loaded lifecycle when it is used under normal operation conditions and greatly improve the overvoltage protection performance against a surge such as switching surge, impulse current, and overvoltage.

(Fourth Embodiment)

The fourth embodiment relates to the invention according to claim 4. To show the functional effects produced by varying the shock adhesive strength of the side-surface high resistance layer to the sintered body in addition to the cases of first and second embodiments where the material of the side-surface high resistance layer and the end-to-end distance are varied, a plurality of types of nonlinear resistors were manufactured as samples by varying the shock adhesive strength, and then, subjected to evaluation.

The nonlinear resistors according to this embodiment were basically formed such that the end-to-end distance was set at a predetermined value within the range of 0 mm to the thickness of the side-surface high resistance layer+0.01 mm. In addition to this structure, the side-surface high resistance layer 3 was formed by varying the shock adhesive strength within the range of 40 mm or more. In this manner, a plurality of nonlinear resistors according to the invention of claim 4 were obtained as samples. Thereafter, the samples were evaluated for its functional effects.

[Preparation of Samples having a Side-surface High Resistance Layer Different in Shock Adhesive Strength]

To show the functional effects (measured by a falling-ball test) produced by the nonlinear resistor having the side-surface high resistance layer 3 with a shock adhesive strength of 40 mm or more to the sintered body, a plurality of nonlinear resistors having a side-surface high resistance layer 3 different in shock adhesive strength were manufactured.

The side-surface high resistance layer 3 manufactured herein was formed by applying an adhesive agent having a mullite ($Al_6Si_2O_{13}$)-containing aluminium phosphate based inorganic adhesive agent as a main component to a side surface of the sintered body 1, and then sintering it. The adhesive agent was cured by controlling the temperature and humidity before the coating. By use of this phenomenon, eight types of nonlinear resistors were formed which had shock adhesive strengths (of the side-surface high resistance layer 3 to the sintered body 1) of 5, 10, 20, 30, 40, 100, and 200 mm.

The shock adhesive strength herein is measured by tilting the nonlinear resistor having the side-surface high resistance layer 3 formed thereon by an angle of 45 degrees to the horizontal surface and dropping a weight of 100 g from a predetermined height to a corner portion of the nonlinear resistor to collide with it. Therefore, when a ball is dropped from a predetermined height, if the side-surface high resistance layer 3 is peeled off from the sintered body 1, the predetermined height is regarded as the shock adhesive strength.

Furthermore, in all samples, the electrode 2 was formed by using aluminium as a main component such that the end-to-end distance was 0 mm.

[Evaluation of Samples having a Different Shock Adhesive Strength]

In the samples thus manufactured, a switching surge (having a predetermined energy at a wavelength of 2 ms) was applied, starting from 100 J/cm$^3$ as an initial energy, while increasing the energy to be applied by 50 J/cm$^3$ every time each of the samples returned to room temperature. The energy at which the sample was broken was measured to evaluate its overvoltage protection performance. The results are shown in FIG. 5.

Figure 5:
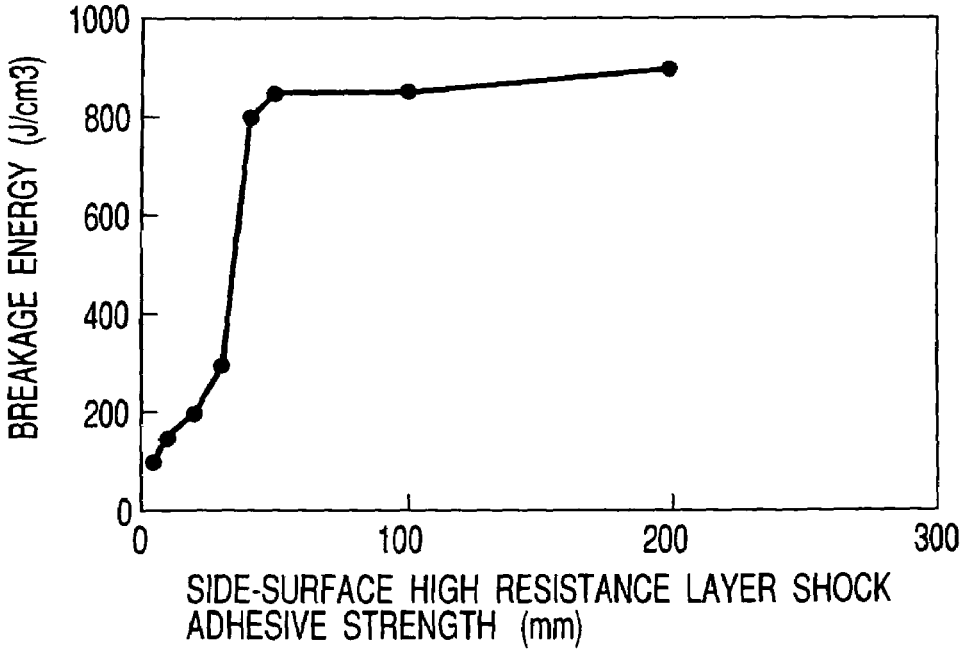
FIG. 5 is a graph showing the relationship between the shock adhesive strength of the side-surface high resistance layer measured by a falling ball test and overvoltage protection performance, with respect to the nonlinear resistor manufactured in accordance with a fourth embodiment.

As is apparent from FIG. 5, in the samples according to the present invention, that is, the samples having a shock adhesive strength of 40 mm or more, no breakage occurs at the time the switching surge having an energy of less than 800 J/cm$^3$ is applied. The breakage occurs when the applied energy is at least 800 J/cm$^3$. In contrast, in the samples outside the scope of the present invention, that is, samples having a shock adhesive strength of 40 mm or less, the breakage occurs when the switching surge having an energy of 400 J/cm$^3$ or less is applied.

The reason why the aforementioned evaluation was resulted can be interpreted as follows. When the formation area of the electrode 2 is enlarged as much as possible until it reaches the side-surface high resistance layer 3 or it reaches near the interface between the sintered body 1 and the side-surface high resistance layer 3, if the shock adhesive strength (measured by the falling ball test) of the side-surface high resistance layer 3 is as small as less than 40 mm, a flashover easily takes place at the interface between the side-surface high resistance layer 3 and the sintered body 1 by application of the switching surge.

In contrast, when the formation area of the electrode 2 is enlarged as much as possible, if the shock adhesive strength (measured by the falling ball test) of the side-surface high resistance layer 3 is 40 mm or more, the flashover is difficult to take place at the interface between the side-surface high resistance layer 3 and the sintered body 1 by application of the switching surge.

In short, in the nonlinear resistor having a shock adhesive strength of less than 40 mm, excellent overvoltage protection performance cannot be obtained. The excellent overvoltage protection performance is obtained only in the nonlinear resistors having a shock adhesive strength of 40 mm or more.

To the nonlinear resistor of each sample, an alternative voltage (current IR, 1 mA flows through a nonlinear resistor at room temperature) was applied under a temperature of 115° C. for 1000 hours. Then, a leakage current (IR (0 h)) was measured immediately after the current application was initiated. Furthermore, current IR (1000 h) was measured after voltage was applied for 1000 hours. The value of IR (1000h)/IR (0 h) was measured to evaluate the ability of the loaded lifecycle. The evaluation results are shown in FIG. 6.

Figure 6:
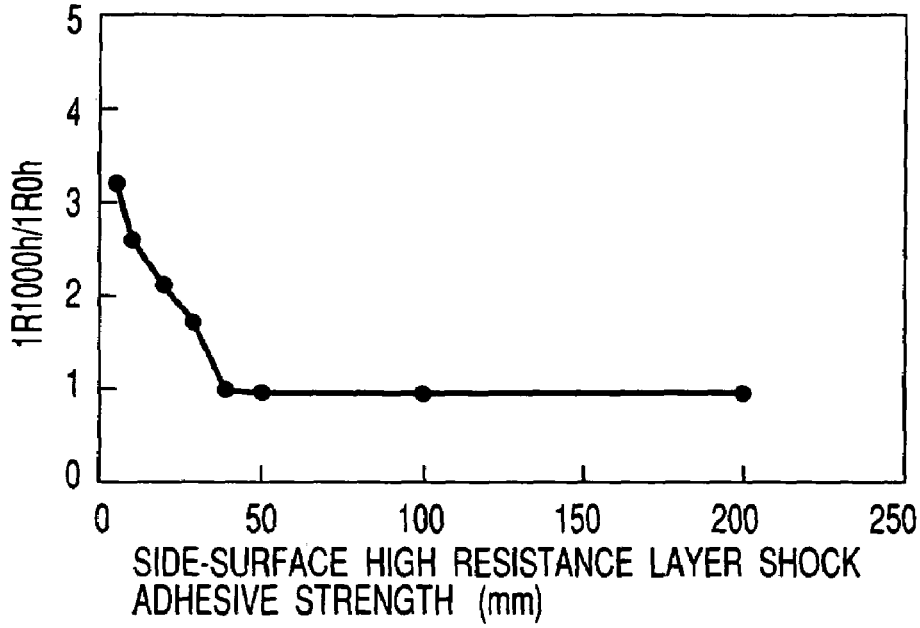
FIG. 6 is a graph showing the relationship between the shock adhesive strength of side-surface high resistance layer measured by the falling ball test and ability of a loaded lifecycle, with respect to the nonlinear resistor manufactured in accordance with the fourth embodiment.

As is apparent from FIG. 6, in the samples according to the present invention, that is, the samples having a shock adhesive strength of 40 mm or more, a value of IR(1000 h)/IR (0 h) is 1 or less. That is, a current flowing through a resistance is stable without exhibiting a significant change to the initial value. Therefore, the samples are determined to have high reliability under practical operation conditions. In contrast, in the samples outside the scope of the present invention, that is, the samples having a shock adhesive strength of less than 40 mm, a value of IR(1000 h)/IR (0 h) is far larger than 1. This means that the current flowing through the resistance is higher than the initial value. Therefore, if operation is continuously made while the current flowing through the resistance may increase, with the result that thermal runaway finally occurs. Therefore, it is conceivably dangerous to put such a nonlinear resistor to practical use.

The reason why the aforementioned evaluation was resulted can be interpreted as follows. When the formation area of the electrode 2 is enlarged as much as possible until it reaches the side-surface high resistance layer 3 or it reaches near the interface between the sintered body 1 and the side-surface high resistance layer 3, if the shock adhesive strength (measured by the falling ball test) of the side-surface high resistance layer 3 is as small as less than 40 mm, a leakage current flowing through the interface between the side-surface high resistance layer 3 and the sintered body 1 increases when the voltage is applied for a long time.

In contrast, when the formation area of the electrode 2 is enlarged as much as possible, if the shock adhesive strength (measured by the falling ball test) of the side-surface high resistance layer 3 is 40 mm or more, the leakage current flowing through the interface between the side-surface high resistance layer 3 and the sintered body 1 does not increase even if voltage is applied for a long time.

Therefore, it is impossible to obtain a stable ability of a loaded lifecycle in the nonlinear resistor having a shock adhesive strength of 40 mm or less. The stable ability of a loaded life cycle can be obtained only in the nonlinear resistors having a shock adhesive strength of 40 mm or more.

(Fifth Embodiment)

The fifth embodiment relates to the inventions according to claims 5 and 7. To show the functional effects produced by varying an electrode material and an electrode forming method in addition to the case of the first embodiment where the shock adhesive strength and the end-to-end distance are varied, a plurality of nonlinear resistors were formed as samples by varying the electrode material and the electrode forming methods, and then, subjected to evaluation.

In the nonlinear resistors according to this embodiment, a predetermined side-surface high resistance layer 3 was basically formed such that the end-to-end distance was set at a predetermined value within the range of 0 mm to the thickness of the side-surface high resistance layer+0.01 mm.

In addition to this structure, a plurality of nonlinear resistors were formed as samples in accordance with claim 5 of the present invention, by varying the electrode material. The electrode material was selected from the group consisting of aluminium, copper, zinc, nickel, gold, silver, titanium and alloys thereof. Thereafter, the samples were evaluated for functional effects.

Furthermore, a plurality of nonlinear resistors were formed as samples in accordance with claim 7 of the present invention, by varying the electrode forming method. The electrode forming method was selected from the group consisting of plasma spraying, arc spraying, high-speed gas flame spraying, screen printing, deposition, transferring, and sputtering. Thereafter, the samples were evaluated for functional effects.

[Preparation of Samples Different in Electrode Material and Electrode Forming Method]

In each sample, the side-surface resistance layer 3 was formed of a mullite ($Al_6Si_2O_{13}$)-containing aluminium phosphate based inorganic adhesive agent as a main component.

Eighteen types of non-linear resistors 2 having the end-to-end distance of 0 mm were formed by varying the material of the electrode 2 and the electrode forming method.

More specifically, twelve types of electrodes 2 different in material were formed by selecting a material from aluminium, copper, zinc, nickel, gold, silver, titanium and copper/zinc alloy, nickel/aluminium alloy, silver/copper alloy, carbon steel, and 13 Cr stainless steel.

Of them, the electrode using aluminium as a main component was formed in accordance with different methods. More specifically, the electrodes 2 was formed by different methods including plasma spraying, arc spraying, high-speed gas flame spraying, screen printing, deposition, transferring, and sputtering. As a result, seven types of nonlinear resistors were prepared.

[Evaluation of the Samples Different in Electrode Material and Electrode Forming Method]

To the samples thus manufactured, a switching surge (having a predetermined energy at a wavelength of 2 ms) was applied starting form 100 J/cm$^3$ as an initial energy, while increasing the energy to be applied by 50 J/cm$^3$ every time the temperature of the sample returned to room temperature. The energy at which the sample was broken was measured to evaluate its overvoltage protection performance. The results are shown in Table 3.

TABLE 3

Relationship between electrode material of nonlinear resistor, electrode forming method, and overvoltage protective efficacy

| Electrode material | Electrode forming method | Breakage energy (J/cm$^3$) |
|---|---|---|
| Aluminium | Plasma spraying | 900 |
| | Arc spraying | 800 |
| | High-speed gas frame spraying | 900 |
| | Screen printing | 800 |
| | Transferring | 850 |
| | Deposition | 800 |
| | Sputtering | 850 |
| Copper | Plasma Spraying | 850 |
| Zinc | Plasma Spraying | 900 |
| Nickel | Plasma Spraying | 900 |
| Gold | Deposition | 800 |
| Silver | Screen printing | 850 |
| Titanium | Plasma Spraying | 900 |
| Copper/zinc alloy | Plasma Spraying | 900 |
| Nickel/aluminium alloy | Plasma Spraying | 850 |
| Silver/copper alloy | Plasma Spraying | 900 |
| Carbon steel | Plasma Spraying | 400 |
| 13Cr stainless steel | Plasma Spraying | 350 |

As is apparent from Table 3, in samples employing the electrode material of the present invention, that is, samples formed of aluminium, copper, zinc, nickel, gold, silver, titanium and copper/zinc alloy, and nickel/aluminium alloy, no breakage occurs when a switching surge having an energy of less than 800 J/cm$^3$ is applied. The breakage occurs when the energy to be applied is 800 J/cm$^3$ or more.

In the samples having the electrodes formed by the electrode forming methods according to the present invention, that is, the samples formed by plasma spraying, arc spraying, high-speed gas flame spraying, screen printing, deposition, transferring, and sputtering, no breakage occurs when a switching surge having an energy of less than 800 J/cm$^3$ is applied. The breakage occurs when the energy to be applied is 800 J/cm$^3$ or more.

In contrast, in the electrodes formed of the material outside the scope of the present invention, that is, the electrode formed of carbon steel and stainless steal, a breakage occurs when a switching surge having an energy of 400 J/Cm$^3$ or less is applied.

The reason why the aforementioned evaluation was resulted can be interpreted as follows: In the nonlinear resistors having electrodes formed by using carbon steel and 13 Cr stainless steel, since the adhesion between the sintered body 1 and the electrode 2 is so poor that the area of the no-current flowing region increases when the current is supplied. Consequently, temperature difference occurs. Due to the thermals stress, the sintered body 1 is broken.

In contrast, in the nonlinear resistor formed of the electrode material according to the present invention, the adhesion between the sintered body 1 and the electrode 2 is strong. Therefore, even if the non current-flowing region is generated when a current is supplied, the area is small. Consequently, no temperature difference occurs in the nonlinear resistor, with the result that the breakage of the sintered body 1 due to thermal stress is successfully prevented.

In the nonlinear resistor formed of the electrode material outside the scope of the present invention, excellent overvoltage protection performance cannot be obtained. The excellent overvoltage performance can be obtained only in the nonlinear resistor using the electrode material of the present invention.

[Effects Produced by Varying Electrode Material and Electrode Forming Method]

As is apparent form the evaluation results mentioned above, if the electrode is formed of aluminium, copper, zinc, nickel, gold, silver, titanium or alloys thereof by plasma spraying, arc spraying, high-speed gas flame spraying, screen printing, deposition, transferring, or sputtering, it is possible to greatly improve the overvoltage protection performance against a surge such as switching surface, impulse current, and overvoltage.

(Sixth Embodiment)

The sixth embodiment relates to the invention according to claim 6. To show the functional effects produced by varying the average thickness of the electrode in addition to the case of the first embodiment where the material of the side-surface high resistance layer and the end-to-end distance are varied, a plurality of types of nonlinear resistors having an electrode different in average thickness were formed as samples, and then, subjected to evaluation.

In the nonlinear resistors according to this embodiment, a predetermined side-surface high resistance layer 3 was basically formed such that the end-to-end distance was set at a predetermined value within the range of 0 mm to the thickness of the side-surface high resistance layer+0.01 mm. In addition to this structure, a plurality of nonlinear resistors were formed as samples by varying the average thickness of the electrode 2 within the range of 5 to 500 μm, according to claim 6 of the present invention. Thereafter, the samples were evaluated for functional effects.

[Preparation of Samples having an Electrode Different in Average Thickness]

In each sample, the side-surface resistance layer 3 was formed of a mullite ($Al_6Si_2O_{13}$)-containing aluminium phosphate based inorganic adhesive agent as a main component.

The electrode 2 was formed of a material containing aluminium as a main component such that the end-to-end distance is 0 mm, while the average thickness of the electrode 2 was varied. As a result, 8 types of non-linear resistors were manufactured having the electrodes of 1, 5, 10, 100, 300, 500, 700, 1000 μm in average thickness.

[Evaluation of Samples having an Electrode Different in Average Thickness]

To the samples thus manufactured, a switching surge (having a predetermined energy at a wavelength of 2 ms) was applied starting form 100 J/cm$^3$ as an initial energy, while increasing the energy to be applied by 50 J/cm$^3$ every time the temperature of the sample returned to room temperature. The energy at which the sample was broken was measured to evaluate its overvoltage protection performance. The results are shown in Table 7.

Figure 7:
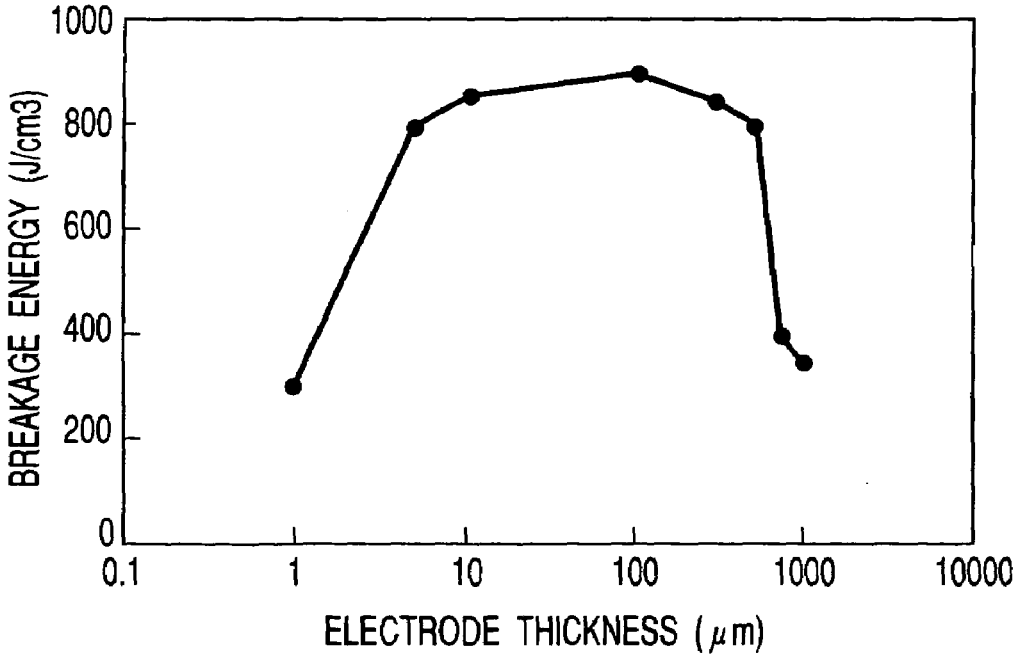
FIG. 7 is a graph showing the relationship between average thickness of an electrode and the overvoltage protection performance with respect to the nonlinear resistor manufactured in accordance with a sixth embodiment.

As is apparent from FIG. 7, in the sample according to the present invention, that is, the samples having an electrode whose average thickness falls within the range of 5 μm to 500 μm, no breakage occurs when a surge having an energy of less than 800 J/cm$^3$ is applied. The breakage occurs when the energy to be applied is 800 J/cm$^3$ or more. In contrast, in the samples outside the scope of the present invention, that is, the samples having the electrodes 2 of 1700 and 1000 μm in average thickness, the breakage occurs when a switching surge having an energy of 400 J/Cm$^3$ or less is applied.

The reason why the aforementioned evaluation was resulted can be interpreted as follows. In the nonlinear resistance having an electrode 2 as thin as less than 5 μm in thickness, the heat capacity becomes too small. Therefore, excellent overvoltage protection performance cannot be obtained. In contrast, if the average thickness of the electrode 2 is as large as more than 500 μm, the adhesion strength of the electrode 2 to the sintered body 1 reduces. Therefore, the excellent overvoltage protection performance cannot be obtained. In contrast, if the average thickness of the electrode 2 falls within the range of 5 μm to 500 μm, the heat capacity of the electrode 2 can be ensured at a predetermined level or more. The adhesion strength of the electrode 2 to the sintered body 1 can be maintained at a predetermined level or more. Therefore, it is possible to obtain excellent overvoltage protection performance.

[Effects Produced by Varying the Average Thickness of the Electrode]

As is apparent from the evaluation results mentioned above, if the electrode is formed having an average thickness within 5 μm to 500 μm in accordance with the present invention, it is possible to ensure heat capacity at a predetermined level or more and adhesion strength appropriately. As a result, it is possible to greatly improve the overvoltage protection performance against the surge such as switching surface, impulse current, and overvoltage.

(Other Embodiment)

The present invention is not limited to the aforementioned embodiments and may be modified in various ways within the scope of the present invention. For example, the dimensions, materials and manufacturing steps of the sintered body are not limited to the description of embodiments, and can be freely modified. More specifically, the features of the present invention reside in manufacturing conditions and structure of the electrode and the side-surface high resistance layer. As long as they can satisfy the features, various sintered bodies are applicable.

As explained in the foregoing, according to the present invention, it is possible to provide a nonlinear resistor and a method of manufacturing the nonlinear resistor which attains a stable ability of a lorded lifecycle under normal operation conditions and tremendously improves the overvoltage protection performance against a surge such as switching surge, lightening impulse, and overvoltage, by forming the side-surface high resistance layer of a predetermined substance such that the end-to-end distance between the end portion of an electrode and the nonlinear resistor end portion including a side-surface insulating layer falls within the range of 0 mm to the thickness of the side-surface high resistance layer+0.01 mm.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A non-linear resistor comprising a sintered body having zinc oxide as a main component;

a side-surface high resistance layer arranged at a side-surface of the sintered body; and an electrode arranged at upper and lower surfaces of the sintered body, wherein an end-to-end distance between an end portion of the electrode and a nonlinear resistor end portion including the side-surface high resistance layer falls within a range of 0 mm to a thickness of the side-surface high resistance layer+0.01 mm;

the side-surface high resistance layer is formed of at least one element selected from substances containing, as a main substance, an inorganic polymer substance having electric insulating characteristics and heat resistance, an amorphous inorganic polymer substance, a glass compound, an amorphous inorganic substance, a crystalline inorganic substance, and an organic polymer compound, and the side-surface high resistance layer is adhered to the sintered body so as to have a shock adhesive strength of 40 mm or more, the shock adhesive strength being a height at which the side-surface high resistance layer is peeled off from the sintered body when the nonlinear resistor having the side-surface high resistance layer is tilted by an angle of 45 degrees to the horizontal surface and a ball of 100 g is dropped from the height to a corner portion of the nonlinear resistor to collide with the nonlinear resistor.

2. The nonlinear resistor according to claim 1, wherein the amorphous polymer substance is an aluminum phosphate based inorganic adhesive which is an inorganic polymer, an amorphous silica, amorphous alumina or a complex of amorphous silica and organosilicate;

the glass compound is a glass containing lead as a main component, a glass containing phosphorus as a main component, or a glass containing bismuth as a main component;

the crystalline inorganic substance is a crystalline inorganic substance containing Zn—Sb—O as a constitutional component; a crystalline inorganic substance containing Zn—Si—O as a constitutional component; a crystalline inorganic substance containing Zn—Sb—Fe—O as a constitutional component; a crystalline inorganic substance containing Fe—Mn—Bi—Si—O as a constitutional component; a crystalline silica ($SiO_2$); alumina ($Al_2O_3$); mullite ($Al_6Si_2O_{13}$), cordierite ($Mg_2Al_4Si_5O_{18}$), titanium oxide ($TiO_2$), or zirconium oxide ($ZrO_2$);

the organic polymer compound is an epoxy resin, polyimide resin, phenol resin, melamine resin, fluorocarbon resin, silicon resin; and the side-surface high resistance layer is formed of at least one type selected from the group containing the aforementioned materials and materials having a complex formed of at least two types of materials selected from the aforementioned materials, as a main component.

3. The nonlinear resistor according to claim 1, wherein a thickness of the side-surface high resistance layer falls within a range of 1 μm to 2 mm.

4. A non-linear resistor comprising:

a sintered body comprising zinc oxide as a main component;

a side-surface high resistance layer arranged at a side-surface of the sintered body; and an electrode arranged at upper and lower surfaces of the sintered body, wherein an end-to-end distance between an end of the electrode and an end of the nonlinear resistor including the side-surface high resistance layer falls within a range of 0 mm to a thickness of the side-surface high resistance layer+0.01 mm, and the side-surface high resistance layer is formed of one member selected from the group consisting of:

a complex of an amorphous silica with an organosilicate, a combination of a crystalline inorganic substance containing Zn—Si—O as a constitutional component with a crystalline inorganic substance containing Zn—Sb—Fe—O as a constitutional component, a mullite-containing aluminum phosphate based inorganic adhesive agent, an alumina-containing aluminum phosphate based inorganic adhesive agent, a silica-containing aluminum phosphate based inorganic adhesive agent, a cordierite-containing aluminum phosphate based inorganic adhesive agent, a combination of a Zn—Si—O crystalline inorganic substance with a Zn—Sb—O crystalline inorganic substance, a combination of a Fe—Mn—Bi—Si—O crystalline organic substance with a Zn—Sb—O crystalline inorganic substance, and an alumina-containing epoxy resin.

5. The nonlinear resistor according to claim 1, wherein a material of the electrode is selected from the group consisting of aluminium, copper, zinc, nickel, gold, silver, titanium and alloys thereof.

6. The nonlinear resistor according to claim 1, wherein an average thickness of the electrode falls within a range of 5 μm to 500 μm.

7. A method of forming a nonlinear resistor according to claim 1, comprising:

forming a side-surface high resistance layer at a side-surface of a sintered body containing zinc oxide as a main component; and forming an electrode at upper and lower surfaces of the sintered body, wherein the electrode is formed by a method selecting from the group consisting of plasma spraying, arc spraying, high-speed gas flame spraying, screen printing, deposition, transferring, and sputtering.

8. The non-linear resistor according to claim 1, wherein the side-surface high resistance layer is formed of a substance selected from the group consisting of:

an aluminum phosphate based inorganic adhesive which is an inorganic polymer; an amorphous alumina; a crystalline inorganic substance containing Zn—Sb—Fe—O as a constitutional component; a crystalline inorganic substance containing Fe—Mn—Bi—Si—O as a constitutional component; a crystalline silica ($SiO_2$); alumina ($Al_2O_3$); mullite ($Al_6Si_2O_{13}$); cordierite ($Mg_2Al_4Si_5O_{18}$); titanium oxide ($TiO_2$); zirconium oxide ($ZrO_2$); a Bi—B—Si glass; a Bi—Zn—B—Si—Al glass; and a Bi—Zn—B—Al glass.

9. the non-linear resistor according to claim 4, wherein the side-surface high resistance layer is adhered to the sintered body so as to have a shock adhesive strength of 40 mm or more, the shock adhesive strength being a height at which the side-surface high resistance layer is peeled off from the sintered body when the nonlinear resistor having the side-surface high resistance layer is tilted by an angle of 45 degrees to the horizontal surface and a ball of 100 g is dropped from the height to a corner portion of the nonlinear resistor to collide with the nonlinear resistor.

* * * * *